US010612364B2

(12) United States Patent
Hered

(10) Patent No.: US 10,612,364 B2
(45) Date of Patent: Apr. 7, 2020

(54) METHOD FOR WITHSTANDING HIGH COLLAPSE LOADS FROM DIFFERENTIAL PRESSURE IN A LIMITED CROSS-SECTION

(71) Applicant: Baker Hughes, a GE company, LLC, Houston, TX (US)

(72) Inventor: William A. Hered, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 156 days.

(21) Appl. No.: 15/819,702

(22) Filed: Nov. 21, 2017

(65) Prior Publication Data

US 2019/0153851 A1 May 23, 2019

(51) Int. Cl.
*E21B 47/01* (2012.01)

(52) U.S. Cl.
CPC ..... *E21B 47/011* (2013.01)

(58) Field of Classification Search
CPC ..... E21B 47/01; E21B 47/011
See application file for complete search history.

(56) References Cited

U.S. PATENT DOCUMENTS

| | | | | |
|---|---|---|---|---|
| 4,738,812 | A * | 4/1988 | Raynal | E21B 7/06 264/251 |
| 5,817,937 | A * | 10/1998 | Beshoory | E21B 4/02 73/152.46 |
| 8,429,961 | B2 * | 4/2013 | Irani | E21B 49/081 73/152.23 |
| 2003/0155121 | A1 * | 8/2003 | Jones | E21B 47/01 166/254.2 |
| 2012/0152518 | A1 * | 6/2012 | Johanning | E21B 47/011 166/65.1 |

* cited by examiner

*Primary Examiner* — D. Andrews
(74) *Attorney, Agent, or Firm* — Parsons Behle & Latimer

(57) ABSTRACT

A downhole tool and method of using the tool that includes a mandrel having at least one pocket formed in an exterior surface of the mandrel. The tool includes a sleeve positioned on the exterior of the mandrel to cover the pocket. A first portion of the sleeve is a conic section and is positioned adjacent to the pocket. The conic section of the sleeve may have a smaller cross-sectional thickness than a supporting portion of the sleeve. A curvature of the inner surface of conic section may differ from the curvature of the inner surface of the supporting section of the sleeve. The inner surface of the conic section may be an arch, a parabolic shape, or the like. The mandrel may include a plurality of pockets and the sleeve may include a plurality of corresponding conic sections separated by supporting sections that engage the exterior of the mandrel.

17 Claims, 3 Drawing Sheets

METHOD FOR WITHSTANDING HIGH COLLAPSE LOADS FROM DIFFERENTIAL PRESSURE IN A LIMITED CROSS-SECTION

FIELD OF THE DISCLOSURE

The embodiments described herein relate to a downhole tool and method of using the downhole tool, the downhole tool having a mandrel with pockets on the exterior configured to store an electronic device, sensor, or the like. The downhole tool includes a sleeve that includes conic sections positioned adjacent to the pockets on the exterior of the mandrel, the conic sections of the sleeve having a different thickness and/or curvature that the other sections of the sleeve.

BACKGROUND

Description of the Related Art

Tools that are used in wellbores may need to be able to withstand potential high collapse loads generated by differential pressures. For example, a downhole tool or system may include various electronics, sensors, or the like, that may not be able to withstand the pressures within a wellbore. Such electronics, sensors, or the like, may also need to be protected from exposure to the fluids within a wellbore. One solution for protecting electronics, sensors, or the like, is to place the devices within an atmospheric chamber.

FIG. 3 shows a cross-section view schematic of a downhole tool 200 that may be used to protect such devices. The tool 200 includes a mandrel 210 having an inner surface 212 and an outer surface 211. A plurality of pockets, or chambers, 215A, 215B, 215C, 215D, 215E, 215F are formed in the exterior or outer surface 211 of the mandrel 210. The pockets 215A, 215B, 215C, 215D, 215E, 215F are configured to house an electronic device 230A, 230B, 230C, 230D, 230E, 230F, which may be a sensor, battery, electronic device, or the like, as would be appreciated by one of ordinary skill in the art having the benefit of this disclosure. A sleeve 220 having an inner surface 224 and an outer surface 225 is configured to slide over the exterior 211 of the mandrel 210 and cover the plurality of pockets 215A, 215B, 215C, 215D, 215E, 215F. The sleeve 220 is configured to prevent wellbore fluid from accessing the pockets 215A, 215B, 215C, 215D, 215E, 215F as well as protecting the devices 230A, 230B, 230C, 230D, 230E, 230F from potential pressure differentials within a wellbore.

The sleeve 220 has a constant cross-sectional thickness 221 around its perimeter. As the tool 200 is used in deeper and deeper wellbores, the cross-sectional thickness 221 may need to be increased to adequately protect the devices 230A, 230B, 230C, 230D, 230E, 230F positioned within the pockets 215A, 215B, 215C, 215D, 215E, 215F of the mandrel 210. If the cross-sectional thickness 221 of the sleeve 220 is not adequate, the potentially large pressure differentials within a wellbore may collapse the sleeve 220 at one or more of the pockets 215A, 215B, 215C, 215D, 215E, 215F potentially damaging the device 230A, 230B, 230C, 230D, 230E, 230F inside. For example, a pressure differential of 20,000 psi, 30,000 psi, or even higher may be exerted on the outer surface 225 of the sleeve 220 as the tool 200 is positioned deeper and deeper into a wellbore. In some applications, there may not be enough space available to use a sleeve 220 having the adequate cross-sectional thickness 221 to withstand the potential pressure differentials within a wellbore.

Other disadvantages may exist.

SUMMARY

The present disclosure is directed to a downhole tool and method of using the downhole tool, the downhole tool having a mandrel with pockets on the exterior configured to store an electronic device, sensor, or the like. The downhole tool includes a sleeve that includes conic sections positioned adjacent to the pockets on the exterior of the mandrel, the conic sections of the sleeve having a different thickness and/or curvature that the other sections of the sleeve.

An embodiment of the present disclosure is a downhole tool comprising a mandrel having an exterior surface with at least one pocket, or chamber, formed in the exterior surface. The tool includes a sleeve having an inner surface and an outer surface with the sleeve being configured to be positioned around the exterior surface of the mandrel to cover the at least one pocket. The sleeve includes a first portion positioned opposite the at least one pocket with second and third portions positioned adjacent to the first portion. The inner surface of the first portion is a conic section that differs from a curvature of the inner surfaces of the second and third portions of the sleeve.

The conic section may comprise a parabolic shape. The conic section may form an arch between the second and third portions of the sleeve. The second and third portions of the sleeve may have a first cross-sectional thickness and the first portion of the sleeve may have a second cross-sectional thickness, which is less than the first cross-sectional thickness of the second and third portions. The second and third portions may be configured to contact the exterior surface of the mandrel upon the application of a pressure external to the sleeve. The first portion of the sleeve may be configured to distribute stress towards the second and third portions of the sleeve.

An embodiment of the present disclosure is a method of using a downhole tool comprising providing a mandrel having a plurality of pockets formed in an exterior of the mandrel. The method comprises providing a sleeve having an inner surface and an outer surface, the sleeve being configured to slide onto the exterior of the mandrel to cover the plurality of pockets. The sleeve has a first plurality of sections with the inner surface having a first curvature and a second plurality of sections having a second curvature that differs from the first curvature. The first plurality of sections are configured to be positioned adjacent to one of the plurality of pockets in between two of the second plurality of sections.

The method may include positioning at least one device within one of the plurality of pockets formed in the exterior of the mandrel. The method may comprise running the downhole tool into a wellbore. The method may comprise providing an arch with the inner surface of each of the first plurality of sections between two adjacent sections of the second plurality of sections. The second plurality of sections may have a larger cross-sectional thickness that a cross-sectional thickness of the first plurality of sections.

An embodiment of the present disclosure is a downhole tool comprising a mandrel having an exterior surface with a plurality of pockets formed in the exterior surface and a sleeve having an inner surface and an outer surface, the sleeve being configured to be positioned around the exterior surface of the mandrel to cover the plurality of pockets. The inner surface of the sleeve having a plurality of conic sections, each conic section being positioned opposite a pocket of the plurality of pockets formed in the exterior surface of the mandrel. The conic sections of the sleeve are separated by a support section of the sleeve.

The inner surface of each conic section may form an arch between two adjacent support sections of the sleeve. The inner surface of each conic section may comprise a parabolic shape between two adjacent support sections of the sleeve. The conic sections of the sleeve may have a smaller cross-sectional thickness that a cross-sectional thickness of the support sections of the sleeve. The mandrel may include six pockets spaced substantially equally around the exterior of the mandrel. At least one pocket may have a substantially rectangular shape and at least one pocket may have a substantially semi-circle shape.

Figure 1:
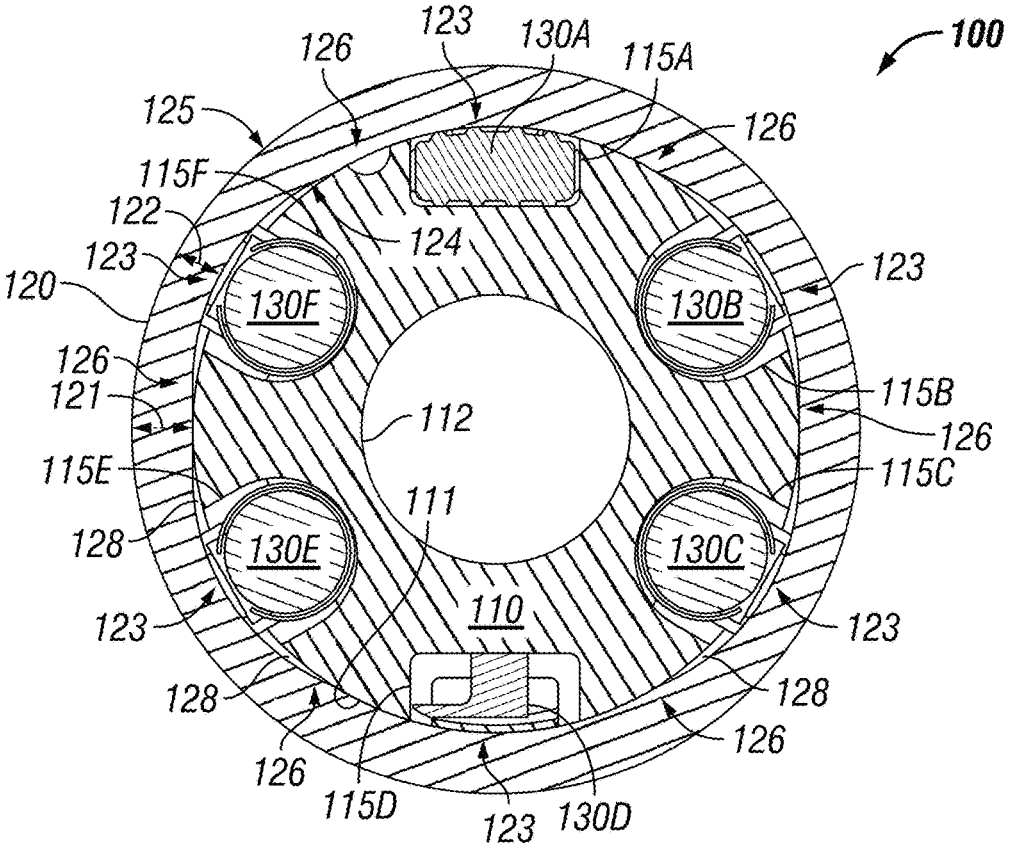
FIG. 1 shows a cross-section view schematic of an embodiment of a downhole tool.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a cross-section view schematic of an embodiment of a downhole tool 100. The tool 100 includes a mandrel 110 having an inner surface 112 and an outer surface 111. A plurality of pockets, or chambers, 115A, 115B, 115C, 115D, 115E, 115F are formed in the exterior or outer surface 111 of the mandrel 110. The pockets 115A, 115B, 115C, 115D, 115E, 115F are configured to house an electronic device 130A, 130B, 130C, 130D, 130E, 130F, which may be a sensor, battery, electronic device, or the like, as would be appreciated by one of ordinary skill in the art having the benefit of this disclosure. For example, devices 130B, 130C, 130E, 130F are shown in FIG. 1 as batteries and devices 130A, 130D are shown as other electronic devices. The number, size, location, and/or configuration of the pockets 115A, 115B, 115C, 115D, 115E, 115F and electronic devices 130A, 130B, 130C, 130D, 130E, 130F are shown for illustrative purposes and may be varied depending on application as would be appreciated by one of ordinary skill in the art having the benefit of this disclosure.

The tool 100 includes a sleeve 120 having an inner surface 124 and an outer surface 125. The sleeve 120 is configured to slide over the exterior 111 of the mandrel 110 and cover the plurality of pockets 115A, 115B, 115C, 115D, 115E, 115F. The sleeve 120 is configured to prevent wellbore fluid from accessing the pockets 115A, 115B, 115C, 115D, 115E, 115F as well as protecting the devices 130A, 130B, 130C, 130D, 130E, 130F from potential pressure differentials within a wellbore, as discussed herein.

The sleeve 120 includes a number of conic sections 123, which are adjacent to the plurality of pockets 115A, 115B, 115C, 115D, 115E, 115F, and a plurality of support sections 126, which separate the conic sections. The support sections 126 have a first cross-sectional thickness 121 that is thicker or larger than conic sections 123, which have a second cross-sectional thickness 122. Likewise, the inner surface 124 of the conic sections 123 of the sleeve 120 has a different curvature than the inner surface 124 of the support sections 126 of the sleeve 120, as shown in FIG. 1. The curvature of the inner surface 124 of the conic sections 123 is configured to direct stress towards the adjacent supports sections 126. The curvature of the inner surface 124 of the conic sections 123 may include various conic shapes, such as but not limited to, a parabolic shape as would be appreciated by one of ordinary skill in the art having the benefit of this disclosure. For example, the curvature of the inner surface 124 of the conic sections 123 may form arches between the adjacent supporting sections 126. The arch of the conic section 123 distributes stress from external pressure towards the adjacent supporting sections 126 that engage the exterior 111 of the mandrel 110, as discussed herein.

FIG. 1 shows the sleeve 120 positioned around the exterior 111 of the mandrel 110. The supporting sections 126 of the sleeve 120 may be configured so a gap 128 is present between at least one or more of the supporting sections 126 and the exterior 111 of the mandrel 110 to enable the sleeve 120 to be positioned onto the exterior 111 of the mandrel 110. As external wellbore pressure is applied to the exterior 125 of the sleeve 120, the pressure causes each supporting section 126 to engage an adjacent portion of the exterior 111 of the mandrel 110 as would be appreciated by one of ordinary skill in the art having the benefit of this disclosure. Alternatively, no gap 128 may exist between the sleeve 120 and the exterior 111 of the mandrel 110 as the sleeve 120 may be configured with an interference fit between each supporting sections 126 and the exterior 111 when positioned on the mandrel 110 as would be appreciated by one of ordinary skill in the art having the benefit of this disclosure.

Figure 2:
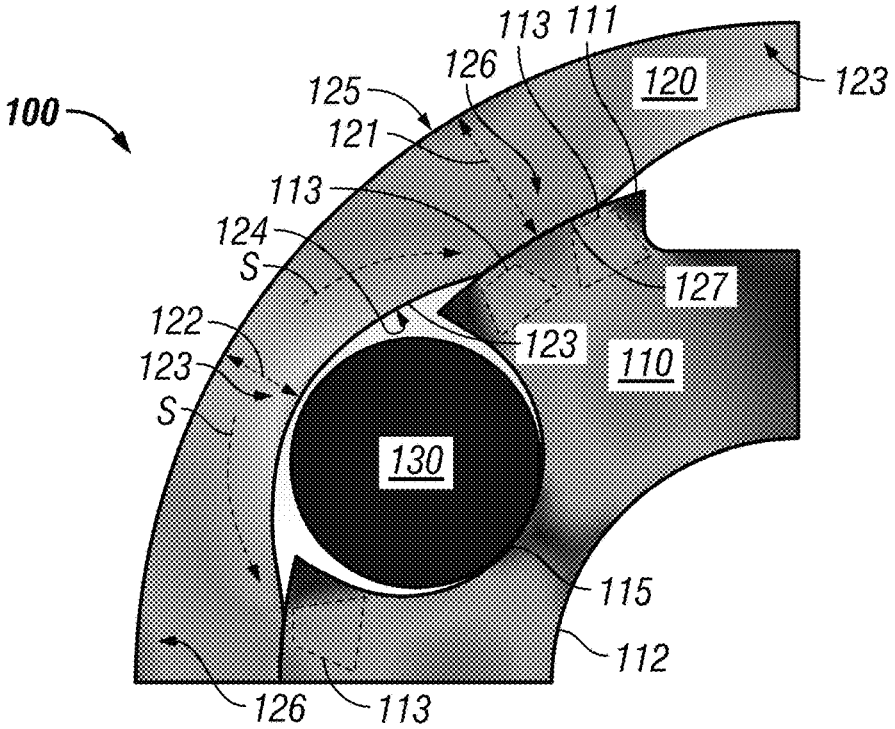
FIG. 2 shows a partial cross-section view of an embodiment of a downhole tool.
Figure 3:
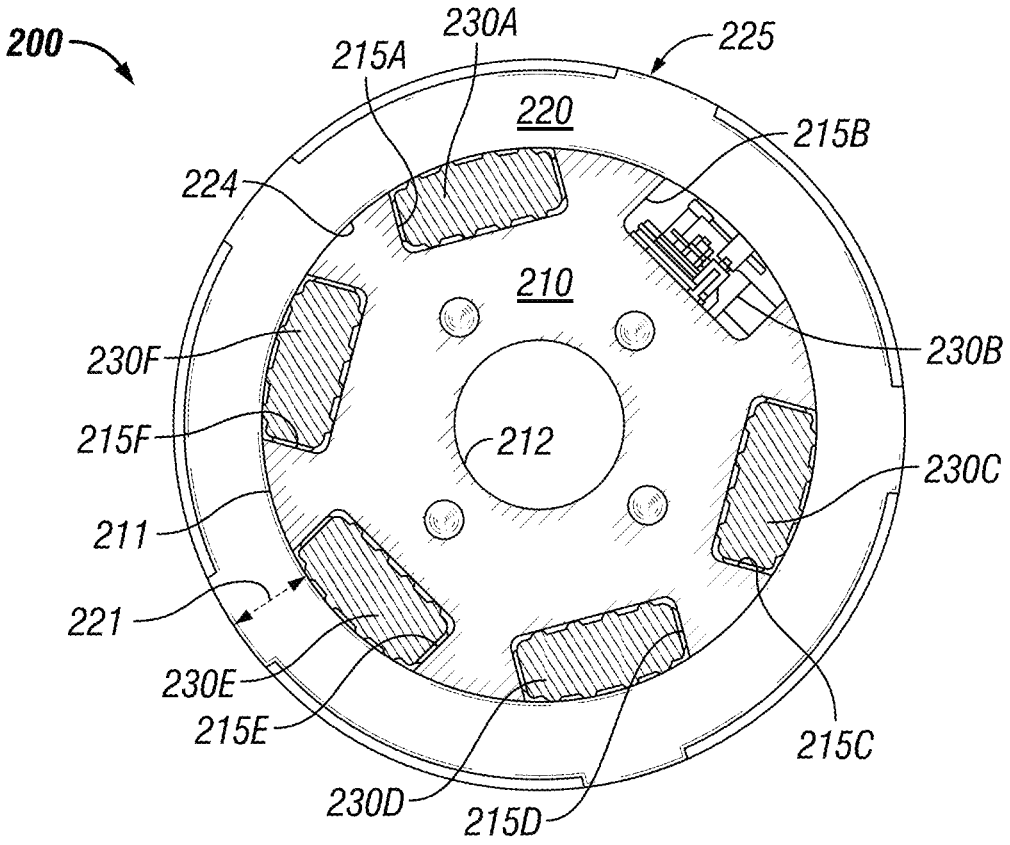
FIG. 3 (Prior Art)
FIG. 3 shows a cross-section view schematic of a prior art downhole tool.

FIG. 2 shows a partial cross-section view of an embodiment of a downhole tool 100. External pressure applied to the exterior 125 of the sleeve 120 causes each supporting section 126 to engage an adjacent portion of the exterior 111 of the mandrel 110. FIG. 2 shows an interface 127 between one support section 126 and a corresponding portion of the mandrel 110. The configuration of adjacent conic section 123 of the sleeve 120 distributes stress, indicated as arrows S, towards the adjacent supporting sections 126 resulting in a substantially uniform stress distribution along the conic section 123 of the sleeve 120. The conic shape of the inner surface 124 of the conic section 123, which may be an arch, parabolic shape, or the like, distributes the stress from the external pressure protecting the device 130 positioned in the adjacent pocket 115 in the mandrel 110. The sleeve 120 also may prevent the entrance of wellbore fluid into the pocket 115 as would be appreciated by one of ordinary skill in the art having the benefit of this disclosure.

The use of a conic shape at the conic section 123 enables the conic section 123 to withstand higher pressure differentials while having a smaller cross-sectional thickness 122 than the cross-sectional thickness 121 of the adjacent supporting sections 126. As discussed herein, the shape of the conic sections 123 distribute stress away from the conic section 123, which may result in regions 113 of the mandrel 110 adjacent to the supporting sections 126 that have higher stress. The larger cross-section thickness 121 of the supporting sections 126 may be able to withstand the higher regions of stress.

Figure 4:
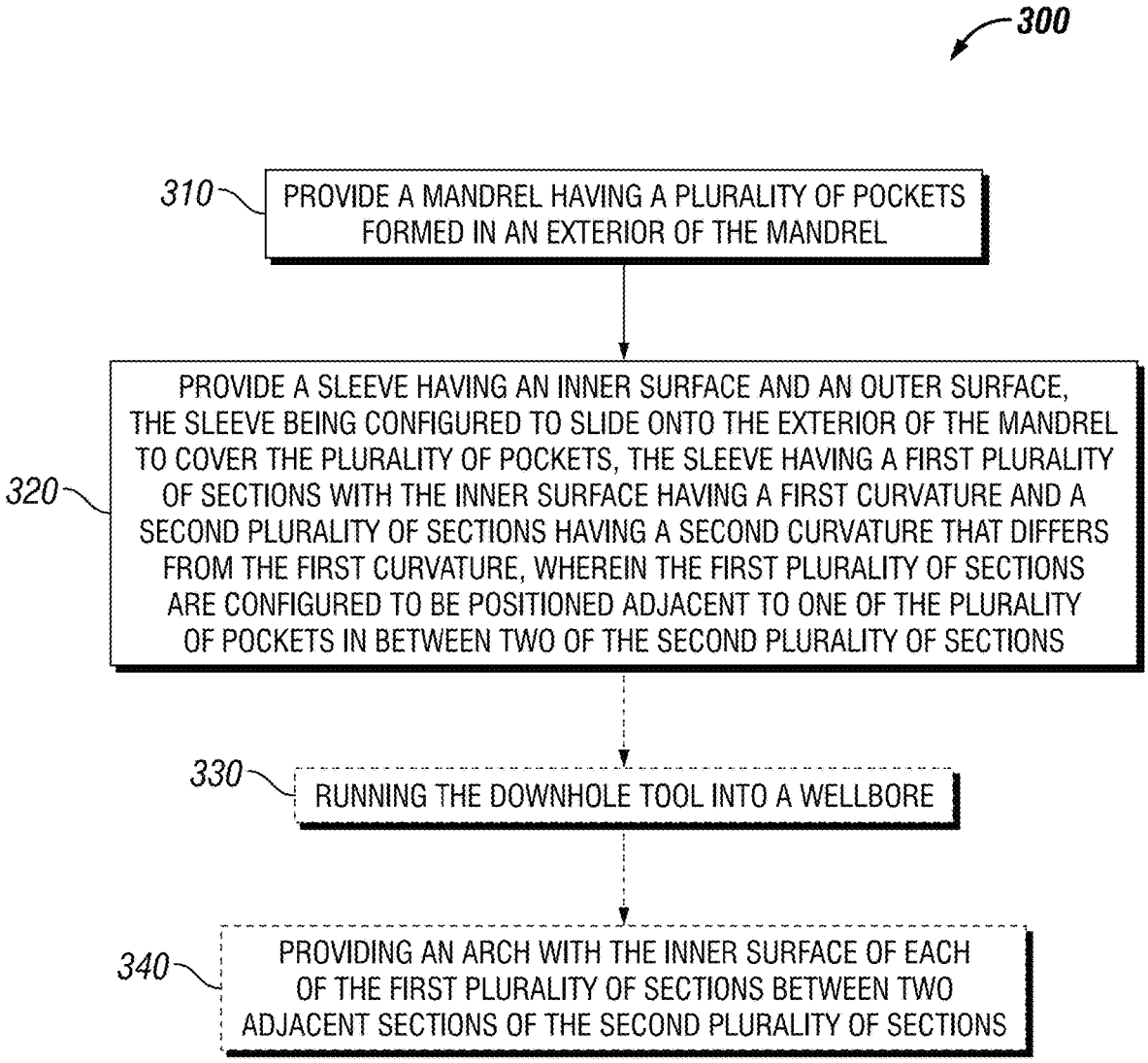
FIG. 4 shows a flow chart of one embodiment of a method of using a downhole tool.

FIG. 4 shows a flow chart of one embodiment of a method 300 of using a downhole tool. The method 300 includes providing a mandrel having a plurality of pockets formed in an exterior of the mandrel, at step 310. The method 300 includes providing a sleeve having an inner surface and an outer surface, the sleeve being configured to slide onto the exterior of the mandrel to cover the plurality of pockets. The sleeve has a first plurality of sections with the inner surface having a first curvature and having a second plurality of sections with the inner surface having a second curvature, which differs from the first curvature. The first plurality of sections are configured to be positioned adjacent to one of the plurality of pockets formed in the exterior of the mandrel and in between two of the second plurality of section.

The method 300 may include the optional step 330 of running the downhole tool into a wellbore. The method 300 may include the optional step 340 of providing an arch with the inner surface of each of the first plurality of sections between two adjacent sections of the second plurality of sections. The first plurality of sections may be conic sections that include a conic shape, such as a parabolic shape, an arch, or the like. The second plurality of sections may be supporting sections that engage a portion of the exterior of the mandrel between the plurality of pockets formed in the exterior of the mandrel.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A downhole tool comprising:

a mandrel having an exterior surface with at least one pocket formed in the exterior surface;

a sleeve having an inner surface and an outer surface, the sleeve being configured to be positioned around the exterior surface of the mandrel to cover the at least one pocket, the sleeve having a first portion positioned opposite the at least one pocket and having second and third portions positioned adjacent to the first portion, wherein the first portion forms a gap with the exterior surface of the mandrel and wherein the second and third portions engage the exterior surface of the mandrel;

wherein the inner surface of the first portion of the sleeve is a conic section that differs from a curvature of the inner surfaces of the second and third portions and wherein the second and third portions of the sleeve having a first cross-sectional thickness and the first portion of the sleeve having a second cross-sectional thickness that is less than the first cross-sectional thickness; and wherein the first portion of the sleeve is configured to distribute stress towards the second and third portions of the sleeve.

2. The tool of claim 1, wherein the conic section further comprises a parabolic shape.

3. The tool of claim 1, wherein the conic section forms an arch between the second and third portions of the sleeve.

4. The downhole tool of claim 1, comprising an electronic device positioned in the at least one pocket.

5. A method of using a downhole tool comprising:

providing a mandrel having a plurality of pockets formed in an exterior of the mandrel; and providing a sleeve having an inner surface, an outer surface, and a substantially constant outer diameter, the sleeve being configured to slide onto the exterior of the mandrel to cover the plurality of pockets, the sleeve having a first plurality of sections with the inner surface having a first curvature and a second plurality of sections having a second curvature that differs from the first curvature, wherein the first plurality of sections are configured to be positioned adjacent to one of the plurality of pockets in between two of the second plurality of sections, wherein the first plurality of sections form a gap with the exterior of the mandrel and wherein the second plurality of sections engage the exterior of the mandrel; and wherein the first plurality of sections of the sleeve are configured to distribute stress towards the second plurality of sections of the sleeve.

6. The method of claim 5, further comprising positioning at least one device within one of the plurality of pockets formed in the exterior of the mandrel.

7. The method of claim 6, further comprising running the downhole tool into a wellbore.

8. The method of claim 6, wherein the at least one device is an electronic device.

9. The method of claim 5, further comprising providing an arch with the inner surface of each of the first plurality of sections between two adjacent sections of the second plurality of sections.

10. The method of claim 9, wherein the second plurality of sections has a larger cross-sectional thickness than a cross-sectional thickness of the first plurality of sections.

11. A downhole tool comprising:

a mandrel having an exterior surface with a plurality of pockets formed in the exterior surface; and a sleeve having an inner surface, an outer surface, and a substantially constant outer diameter, the sleeve being configured to be positioned around the exterior surface of the mandrel to cover the plurality of pockets, the inner surface of the sleeve having a plurality of conic sections, each conic section being positioned opposite a pocket of the plurality of pockets formed in the exterior surface of the mandrel, each conic section forms a gap with the exterior surface of the mandrel; and wherein each conic section of the sleeve is separated by a support sections of the sleeve, wherein the support sections engage the exterior surface of the mandrel and wherein each conic section of the sleeve is configured to distribute stress adjacent portions of the sleeve.

12. The tool of claim 11, wherein the inner surface of each conic section forms an arch between two adjacent support sections of the sleeve.

13. The tool of claim 11, wherein the inner surface of each conic section further comprises a parabolic shape between two adjacent support sections of the sleeve.

14. The tool of claim 11, wherein the conic sections have a smaller cross-sectional thickness than a cross-sectional thickness of the support sections of the sleeve.

15. The tool of claim 11, wherein plurality of pockets comprises six pockets spaced substantially equally around the exterior of the mandrel.

16. The tool of claim 15, wherein at least one pocket has a substantially rectangular shape and at least one pocket has a substantially semi-circle shape.

17. The tool of claim 11, comprising an electronic device positioned within a pocket of the plurality of pockets.

* * * * *